US006855375B2

(12) United States Patent
Nakagawa et al.

(10) Patent No.: US 6,855,375 B2
(45) Date of Patent: Feb. 15, 2005

(54) METHOD FOR PRODUCING WATER-REPELLENT FILM

(75) Inventors: Tohru Nakagawa, Shiga (JP); Tatsuya Hiwatashi, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 61 days.

(21) Appl. No.: 10/392,546

(22) Filed: Mar. 20, 2003

(65) Prior Publication Data

US 2003/0198747 A1 Oct. 23, 2003

(30) Foreign Application Priority Data

Mar. 28, 2002 (JP) ..... 2002-092121

(51) Int. Cl.[7] ..... B05D 3/02
(52) U.S. Cl. ..... 427/387
(58) Field of Search ..... 427/387

(56) References Cited

U.S. PATENT DOCUMENTS

| | | | | |
|---|---|---|---|---|
| 3,627,801 A | * | 12/1971 | Pierce et al. | 556/431 |
| 5,266,358 A | | 11/1993 | Uemura et al. | |
| 5,328,768 A | | 7/1994 | Goodwin | |
| 5,372,888 A | | 12/1994 | Ogawa et al. | |
| 5,424,130 A | | 6/1995 | Nakanishi et al. | |
| 5,948,476 A | * | 9/1999 | Otake et al. | 427/352 |
| 6,627,264 B1 | * | 9/2003 | Tomita et al. | 427/387 |

FOREIGN PATENT DOCUMENTS

| | | | |
|---|---|---|---|
| JP | 03-014592 | * | 1/1991 |
| JP | 5-112757 | | 5/1993 |
| JP | 5-171111 | | 7/1993 |
| JP | 6-143586 | | 5/1994 |
| JP | 6-171094 | | 6/1994 |
| JP | 2500816 | | 3/1996 |
| JP | 2525536 | | 5/1996 |
| JP | 2555797 | | 9/1996 |
| JP | 10-323979 | | 12/1998 |
| JP | 2874391 | | 1/1999 |
| WO | WO 02-10240 | * | 2/2002 |
| WO | WO 02/10258 | * | 2/2002 |

OTHER PUBLICATIONS

Nakagawa et al, Japanese Journal of Applied Physics, 41(61A), pp 3896–3901, Jun. 2002.*
Dvornic et al, Macromolecules, 27(20), pp 5833–5838, 1994.*

* cited by examiner

*Primary Examiner*—Erma Cameron
(74) *Attorney, Agent, or Firm*—Merchant & Gould P.C.

(57) ABSTRACT

A method for forming a water-repellent film on a solid substrate. The method includes: preparing a mixed solution of a silane coupling agent (A) including reactive functional groups at both ends and a hydrocarbon chain and a benzene ring in the middle part; a silane coupling agent (B) including a fluorocarbon chain at one end and a reactive functional group at another end; and a chemical material including at least an organic solvent, water and acid catalyst; allowing hydrolysis and dehydration polymerization reaction of the silane coupling agents (A) and (B) to proceed; diluting the solution; applying the solution to the substrate and heating the substrate, thereby forming a polymer film of the silane coupling agent (A) and the silane coupling agent (B). Thus, there is provided a method for producing an alkali resistant water-repellent film at low cost.

13 Claims, 5 Drawing Sheets

METHOD FOR PRODUCING WATER-REPELLENT FILM

FIELD OF THE INVENTION

The present invention relates to a method for producing a water-repellent film having a high alkali resistance. In particular, it relates to a method for producing a water-repellent film at low cost.

BACKGROUND OF THE INVENTION

A water-repellent film, which can repel water and oil and allow easy removal of materials attached to the surface thereof, has been used widely in various fields. For example, by forming a water-repellent film on windows of an automobile, it is possible to secure an excellent view because the windows can repel water even on rainy days.

Furthermore, by forming a water-repellent film on such places as the surface of cooking equipment, kitchen, bathroom, and the like, dirt can be removed easily from such places, and consequently, the care thereof becomes easy. Furthermore, in recent years, such a water-repellent film has been used as a main component of an ink jet head of an ink jet type recording apparatus.

Conventionally, in order to form a water-repellent film on a solid substrate, in general, polytetrafluoroethylene (PTFE) and the derivatives thereof, which have water repellency, have been applied to the substrate to form a film. However, PTFE and the derivatives thereof have a small surface energy and even if they are applied directly to the substrate to form a film, the film peels off from the substrate easily. Therefore, in order to secure the adhesiveness between the film and the substrate, there have been employed a method of roughening the surface of the substrate and then applying a water-repellent film to the roughened surface, and a method of roughening the surface of the substrate, and forming a primer layer (adhesive layer) made of polyethylene sulphide, etc., on the roughened surface, followed by sintering a water-repellent film. Furthermore, when the solid substrate is made of a metal, a method of plating particles of PTFE and the derivatives thereof together with the metal may be employed.

On the other hand, there have been proposed methods of forming a water-repellent film having an excellent adhesiveness directly on the surface of a substrate by using a silane coupling agent without roughening the surface of the substrate. The following are explanations of five conventional examples of methods using a silane coupling agent.

[First Method Example]

There is described a method for forming a water-repellent monomolecular or polymer film by allowing fluoroalkyl trichlorosilane such as $CF_3(CF_2)_8C_2H_4SiCl_3$ to react with a substrate (for example, publications of JP 2500816, JP 2525536). In the above-mentioned chemical formula, $CF_3(CF_2)_8C_2H_4$— represents a fluoroalkyl group, and —$SiCl_3$ represents a trichlorosilyl group. In this method, a substrate having active hydrogen on the surface thereof is brought into contact with a solution in which fluoroalkyl trichlorosilane is dissolved so as to allow a chlorosilyl group (—SiCl) to react with active hydrogen, thus forming —Si—O— bonding onto the surface of the substrate. As a result, a fluoroalkyl chain is fixed to the substrate via the —Si—O— bonding. Herein, the fluoroalkyl chain provides a film with water repellency. Depending on the film formation conditions, the water-repellent film becomes a monomolecular film or a polymer film.

[Second Method Example]

There is described a method in which a porous substrate impregnated with a compound containing a fluoroalkyl chain of fluoroalkyl alkoxysilane such as $CF_3(CF_2)_8C_2H_4Si(OCH_3)_3$ is heated in a vacuum to evaporate the compound, thus providing the surface of the substrate with water repellency (see JP 6 (1994)-143586A). In order to improve the adhesiveness between the water-repellent film and the substrate, this method proposes that an intermediate layer made of silicon dioxide, etc. be provided.

[Third Method Example]

There is described a method of forming titanium, or titanium oxide, indium-tin oxide film on the substrate, and forming fluoroalkyl silane thereon by a vacuum evaporation method (see JP 10 (1998)-323979A).

[Fourth Method Example]

There is described a method of forming fine particles of oxides such as zirconia, alumina, and the like, on the surface of a substrate, and then applying fluoroalkylchlorosilane, fluoroalkylalkoxysilane, or the like (see JP 6 (1994)-171094A).

[Fifth Method Example]

There is described a method of subjecting a mixed solution obtained by adding metal alkoxide to fluoroalkylalkoxysilane, then applying the solution to the substrate and sintering thereof, thereby forming a water-repellent film in which molecules having a fluoroalkyl chain are found in the metal oxide (Publications of JP 2687060, JP 2874391, JP 2729714, JP 2555797). In these methods, a fluoroalkyl chain provides the film with water repellency, and metal oxide provides the film with a high mechanical strength.

Since a water-repellent film using a silane coupling agent can be formed on various substrates without performing a pretreatment, it can be expected to be applied in various fields. It is particularly useful in an ink jet head. However, a conventional water-repellent film using a silane coupling agent lacks durability against alkaline agents.

The conventional monomolecular film or polymer film using a silane coupling agent as mentioned in the above method examples 1 and 2, is bonded to the substrate via —Si—O— bonding. However, since this bonding is hydrolyzed easily in an alkaline solution, when it is dipped in an alkaline solution, it disappears from the substrate. That is, such a film lacks durability in an alkali solution. In particular, in the method mentioned in the second method example, since the adhesive layer is made of silicon dioxide that easily is dissolved in an alkaline solution, therefore this water-repellent film lacks durability in an alkaline solution.

Then, the third and fourth method examples provide a method in which in order to improve the alkali resistance, an alkali resistant lower film made of titanium oxide, titanium, zirconia particles, alumina particles, etc. is formed under a water-repellent film. Thus, a water-repellent film hardly is peeled off from the solid substrate due to the lower layer is breaking away. On the other hand, the problem that hydrogen bonding or siloxane bonding is broken by alkaline has not been solved completely. The reason therefore will be mentioned below. The water-repellent films proposed in the conventional methods use a silane coupling agent having a reactive group only on one end of the linear chain molecule, for example, fluoroalkyl alkoxysilane and fluoroalkyl chlorosilane, etc. In such coupling agents, as shown in FIG. 3, due to the steric hindrance between molecules, three-dimensional polymerization between molecules hardly occurs and the film density is lower than that of a general polymeric polymer. A silane coupling agent 61 causes a hydration reaction with a hydroxyl group on the surface of the substrate to form siloxane bonding, or is fixed by hydrogen bonding. An arrow 62 shows a portion in which the polymerization reaction occurs due to the hydration.

Therefore, as shown in FIG. 4A, as the substrate 71 has the higher density of hydroxyl groups on the surface of the substrate, the density of the film (a film of the silane coupling agent bonded to the substrate) 72 in the vicinity of the substrate becomes higher. Herein, as shown in FIG. 4B, since a lower film 73 is made of titanium oxide, titanium, zirconia, etc., the density of hydroxyl groups on such a film is low, and the density of the water-repellent film (a film of the silane coupling agent bonded to the substrate) 74 that is in contact with the lower film is low.

FIG. 5 is a schematic view showing a state in which water-repellent films 82 and 81 formed on a lower layer 83 having a low density of hydroxyl groups are exposed to an alkali component. In the nearer part of the lower film 83, the silane coupling molecules (a water-repellent film in the vicinity of the lower film) 82 are fixed to the lower film 83 via hydrogen bonding and siloxane bonding, and in the more distant part from the lower film 83, the low density water-repellent film (a water-repellent film distant from the lower film) 81 is formed. When an alkaline ink is brought into contact with this film, ions ($OH^-$) 84 as alkaline components pass through the film 81 and penetrate into the lower film 83. When the density of the water-repellent film 82 in the vicinity of the lower film is small, ions 85 enter the interface between the film 82 and the lower film 83 and break the hydrogen bonding and the siloxane bonding therein. Even if the lower film has much durability against alkali solution, if the density of hydroxyl groups on the surface thereof is low, the alkali resistance of the water-repellent film decreases.

Furthermore, in order to improve the alkali resistance, the fifth method example is useful, in which a molecule having a fluoroalkyl chain is contained in the metal oxide such as titanium oxide, zirconium oxide, or the like, which has the durability in an alkaline solution. However, these metal oxides are required to be produced by subjecting titanalkoxide and zirconiumalkoxide to hydrolysis and dehydration polymerization, and these alkoxides have high reactivity and hydrolysis proceeds quickly in the air. Therefore, a so-called pot life of these alkoxides is short and it is hard to handle a coating solution using these alkoxides for applying a water-repellent film. Therefore, silicone alkoxide that is stable in the air has been used widely. However, silicon oxide formed from the silicon alkoxide is solved in an alkali solution. Therefore, the water-repellent film using silicone alkoxide has a low durability in an alkaline solution.

These water-repellent films produced using a silane coupling agent have a problem that, in general, a silane coupling agent is expensive and the cost of industrial productivity accordingly becomes higher, in addition to the problem that the water-repellent film has a low alkali resistance.

SUMMARY OF THE INVENTION

With the foregoing in mind, it is an object of the present invention to provide a method for producing an alkali resistant water-repellent film at low cost.

In order to achieve the above-mentioned object, the method for producing a water-repellent film on a solid substrate according to the present invention includes: preparing a mixed solution of a silane coupling agent (A) including reactive functional groups at both ends and a hydrocarbon chain and a benzene ring in the middle part; a silane coupling agent (B) including a fluorocarbon chain at one end and a reactive functional group at another end; and a chemical material including at least an organic solvent, water and acid catalyst; allowing hydrolysis and dehydration polymerization reaction of the silane coupling agent (A) and the silane coupling agent (B) to proceed; then diluting the mixed solution; and applying the mixed solution to the substrate and heating the substrate, thereby forming a polymer film of the silane coupling agent (A) and the silane coupling agent (B).

DESCRIPTION OF THE PREFERRED EMBODIMENTS

Figure 1:
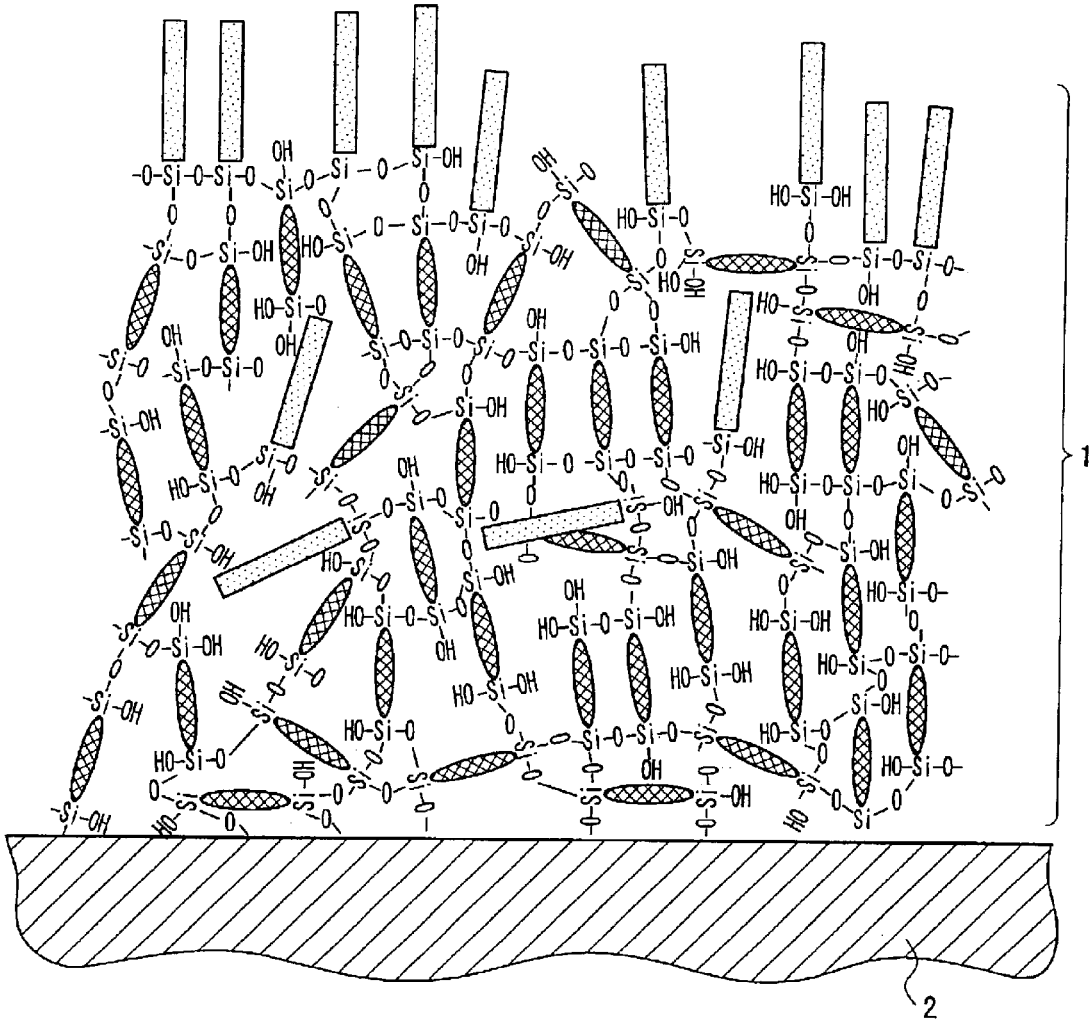
FIG. 1 is a schematic view showing a structure of a water-repellent film according to one example of the present invention.
Figure 1:
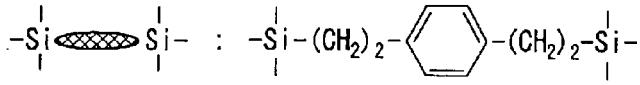
Figure 1:
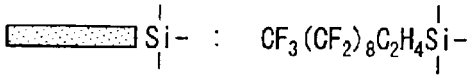

The method of the present invention uses a molecule (A) having at least one or more of siloxane bonding (—Si—O—) at both ends and a hydrocarbon chain and a benzene ring in the middle part and a molecule (B) having a water-repellent fluorocarbon chain at one end and at least one or more of sloxane bonding (—Si—O—) at another end, and forms a polymer of the molecule (A) and the molecule (B). Thus, it is possible to produce a water-repellent film having a high alkali resistance. In such a producing method, a solution including the silane coupling agents (A) and (B) at high concentration is prepared; the reaction of these silane coupling agents is promoted; and then the solution is diluted. Consequently, it is possible to reduce the amount of the silane coupling agents (A) and (B) to be used. In general, since a silane coupling agent is expensive, according to the present invention, a water-repellent film can be produced at low cost.

Furthermore, if the concentration of the silane coupling agent (A) in the mixed solution before being diluted is 0.5 vol % or more, the reaction of the silane coupling agent is promoted sufficiently in the mixed solution.

Furthermore, if the reactive functional group is an alkoxyl group, the silane coupling agents (A) and (B) form a polymer easily. Thus, a water-repellent film that is excellent in alkali resistance and heat resistance can be formed easily.

It is preferable that the silane coupling agent (A) is expressed by the following general formula (a):

$$X_sQ_{3-s}Si(CH_2)_tC_6H_4(CH_2)_uSiR_{3-m}X_m \quad (a)$$

wherein Q and R represent a methyl group or an ethyl group; t and u represent a natural number between 1 and 10; s and m represent a natural number between 1 and 3, when s=1 and m=1 are satisfied, two Qs and Rs are present, respectively, but each of the two Qs and Rs may have a different structure; $C_6H_4$ represents a phenylene group; and X represents an alkoxyl group, chlorine, acyloxy, or amine.

Furthermore, it is preferable that the silane coupling agent (B) is expressed by the following general formula (b):

$$CF_3(CF_2)_nC_2H_4SiR_{3-m}X_m \quad (b)$$

wherein R represents a methyl group or an ethyl group; n represents a natural number between 1 and 12; m represents a natural number between 1 and 3, when m=1 is satisfied, two Rs are present, but each of the two Rs may have a different structure; and X represents an alkoxyl group, chlorine, acyloxy, or amine.

It is preferable that in the mixed solution, the concentration of the silane coupling agent (A) is 0.5 vol % or more and 30 vol % or less; the concentration of the silane coupling agent (B) is 0.05 vol % or more and 3 vol % or less; the concentration of water is 0.1 vol % or more and 30 vol % or less; and the rest includes an organic solvent and acid catalyst. The acid catalyst may be added in ppm order or more.

It is preferable that the organic solvent is at least one selected from the group consisting of ethanol, propanol, butanol and 2,2,2-trifluoroethanol.

It is preferable that the acid catalyst is either at least one inorganic acid selected from the group consisting of hydrochloric acid and nitric acid, or an organic acid, such as acetic acid.

It is preferable that the silane coupling agent (A) and the silane coupling agent (B) are subjected to hydrolysis and dehydration polymerization reaction to form an oligomer.

It is preferable that the hydrolysis and dehydration polymerization reaction of the silane coupling agent (A) and the silane coupling agent (B) are carried out at temperatures of 0° C. or more and 70° C. or less for 1 minute or longer and 240 minutes or shorter.

It is preferable that the mixed solution is diluted with at least one diluent selected from the group consisting of ethanol, propanol, butanol and 2,2,2-trifluoroethanol.

It is preferable that the mixed solution is diluted with the diluent in the range from twice to 20 times.

It is preferable that the temperature for heating the substrate is in the range from 100° C. to 400° C.

The present inventors have performed various analyses and experiments as to the effect of an alkali solution on a water-repellent film and the mechanism thereof and have found a method for producing a highly alkali resistant and heat resistant water-repellent film by using silane coupling agents at low cost.

Hereinafter, in order to understand the present invention more easily, the present invention will be explained by way of embodiments, but the present invention is not necessarily limited to this embodiment.

A coupling part, —Si—X, (X represents an alkoxyl group, chlorine, acyloxy, or amine) of the silane coupling agent participates in the reactions expressed by the following chemical formulae Formula 1 to Formula 3.

$$—Si—X+H_2O \rightarrow —Si—OH+HX \quad \text{(Formula 1)}$$

$$—Si—X+—Si—OH \rightarrow —Si—O—Si—+HX \quad \text{(Formula 2)}$$

$$—Si—OH+—Si—OH \rightarrow —Si—O—Si—+H_2O \quad \text{(Formula 3)}$$

The reaction expressed by Formula 1 shows the generation of a silanol group (Si—OH) by a hydrolysis; Formula 2 shows the generation of a siloxane bonding (—Si—O—) by a condensation reaction, and Formula 3 shows the generation of a siloxane bonding (—Si—O—) by a dehydration polymerization that is a kind of condensation reaction, respectively.

Figure 2:
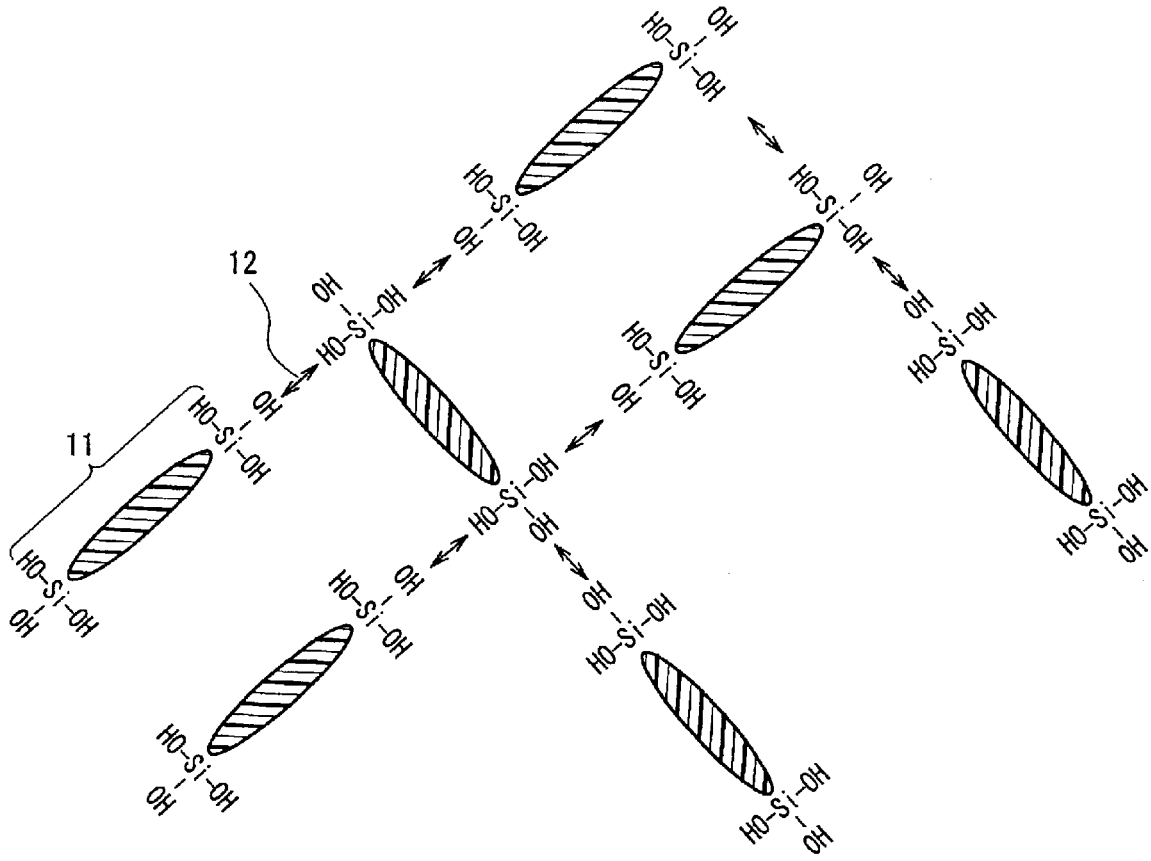
FIG. 2 is a schematic view showing a process in which a high density polymer film is formed according to one embodiment of the present invention.
Figure 3:
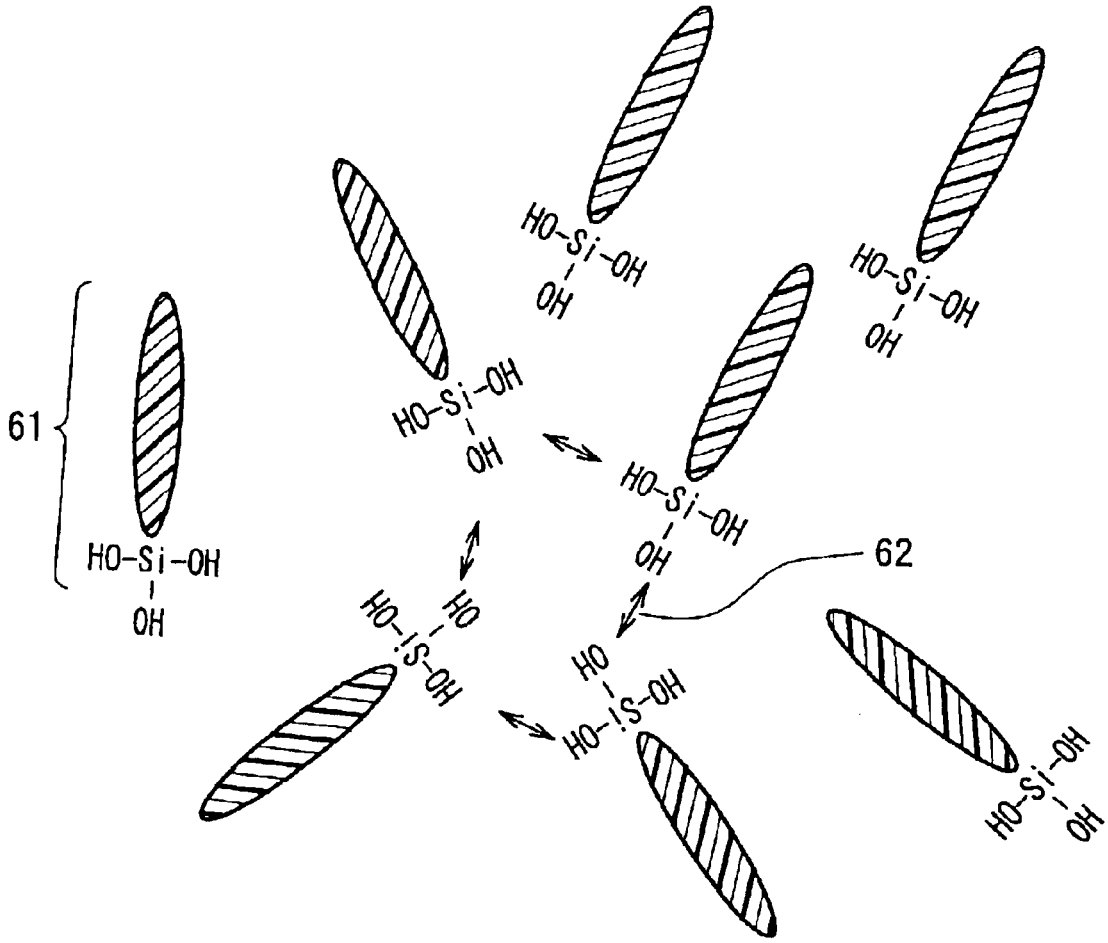
FIG. 3 PRIOR ART
FIG. 3 is a schematic view showing a polymerization of a silane coupling agent having a reaction group at only one end according to a conventional example.
Figure 4A:
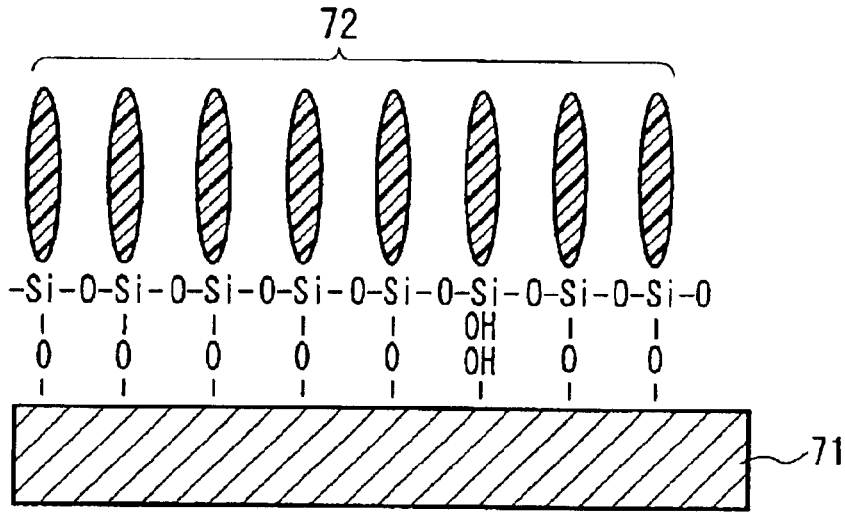
FIG. 4A PRIOR ART
FIG. 4A is a schematic view showing a structure of a silane coupling agent bonded to a substrate having hydroxyl groups at high density on the surface thereof according to a conventional example.
Figure 4B:
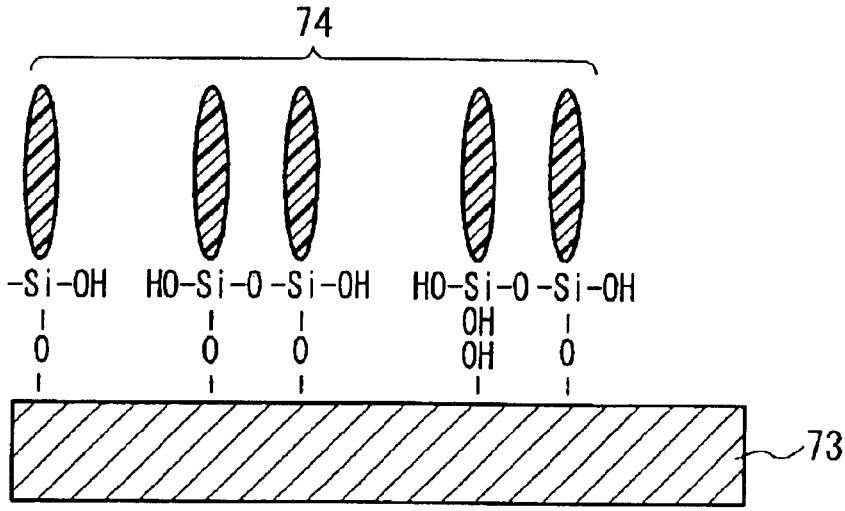
FIG. 4B PRIOR ART
FIG. 4B is a schematic view showing a structure of a silane coupling agent bonded to a substrate having hydroxyl groups at low density on the surface thereof according to a conventional example.
Figure 5:
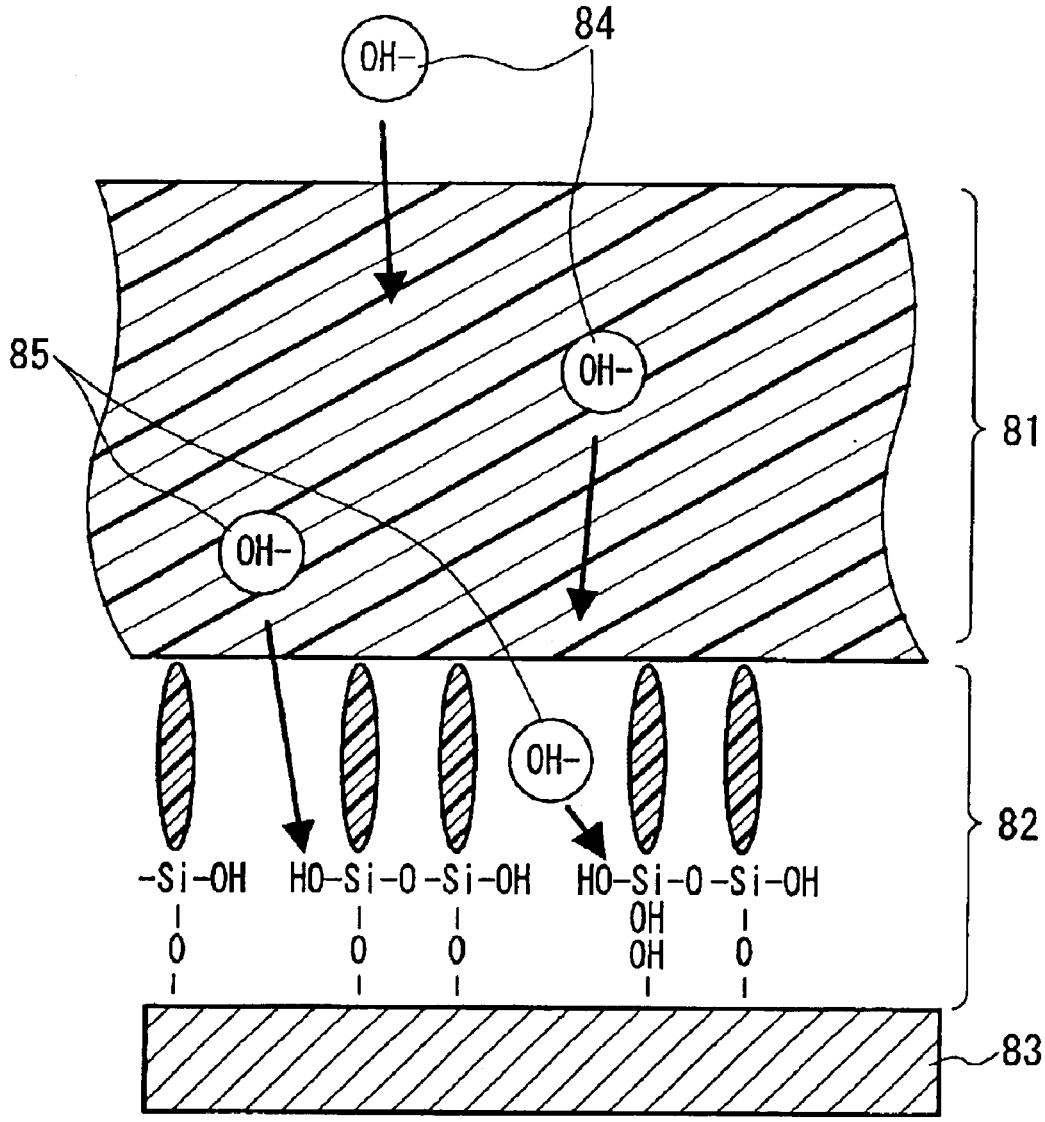
FIG. 5 PRIOR ART
FIG. 5 is a schematic view showing a state in which a water-repellent film bonded to a substrate having hydroxyl groups at low density is exposed to an alkali component.

Right after a predetermined amount of silane coupling agent, organic solvent, water and acid catalyst are mixed, the reactions expressed by the chemical formulae Formula 1 to Formula 3 occur. Therefore, the mixed solution contains a hydrolyzate, a dehydrated polymer, or a molecule having unreacted reactive functional groups of the silane coupling agent. When this mixed solution is diluted with an organic solvent and then applied to the substrate, a film is formed on the substrate. Right after the application, the film includes a silane coupling agent, solvent, water, and acid catalyst. However, when the substrate is heated, for example, at 100° C. or more, solvent, water and acid catalyst are evaporated, and accordingly, unreacted reactive functional groups become silanol or the dehydration polymerization reaction between silanol groups proceeds. As a result, a solid thin film is formed on the substrate. As shown in FIG. 2, since a silane coupling agent (A) 11 has reactive functional groups at both ends of the molecule, dehydration polymerization reaction takes place in a portion as shown by an arrow 12 so as to form a high density three-dimensional polymer film. Therefore, the formed film has a structure in which the silane coupling agent (B) is fixed to the three-dimensional polymer film of the silane coupling agent (A) via siloxane bonding. Note here that in the film, the silane coupling agent (A) and the silane coupling agent (B) are bonded to each other via siloxane bonding to form a polymer film. However, in the film, unreacted reactive functional groups or silanol groups (Si—OH) may remain. The higher the sintering temperature is, the fewer of these groups remain. Furthermore, when hydroxyl groups (—OH) are present on the surface of the substrate, the silane coupling agent causes a dehydration reaction with hydroxyl groups to form siloxane bonding or hydrogen bonding. Therefore, the water-repellent film is fixed to the substrate firmly.

An example of the silane coupling agent (A) includes $$X_sQ_{3-s}Si(CH_2)_tC_6H_4(CH_2)_uSiR_{3-m}X_m$$

(wherein Q and R represent a methyl group or an ethyl group; t and u represent a natural number between 1 and 10; s and m represent a natural number between 1 and 3, when s=1 and m=1 are satisfied, two Qs and Rs are present respectively, but each of the two Qs and Rs may have a different structure; $C_6H_4$ represents a phenylene group; and X represents an alkoxyl group, chlorine, acyloxy, or amine).

Furthermore, an example of the silane coupling agent (B) includes $$CF_3(CF_2)_nC_2H_4SiR_{3-m}X_m \quad (b)$$

wherein R represents a methyl group or an ethyl group; n represents a natural number between 1 and 12; m represents a natural number between 1 and 3, when m=1 is satisfied, two Rs are present, but each of the two Rs may have a different structure; and X represents an alkoxyl group, chlorine, acyloxy, or amine. Herein, in order to provide a film with high water repellency, n is preferably in the range from 6 to 10.

In order to apply a coating solution to the substrate so as to form a film, the coating solution desirably has fluidity. In order to obtain the fluidity, it is desirable that only a part of the silane coupling agent in the coating solution is polymerized. This is because if all of the silane coupling agents are polymerized, the coating solution becomes a gel (a solid state including a solution) and loses fluidity, making it impossible to apply the coating solution to the substrate. In the case where X of the silane coupling agent is chlorine, the reactivity of the coupling part is too high. Therefore, unless the amount of water is strictly controlled, the coating solution easily becomes a gel. On the contrary, in the case where X is an alkoxyl group, hydrolysis and dehydration polymerization reaction proceed slowly in the presence of water and acid, so that the coating solution can be applied to the substrate easily.

FIG. 1 is a schematic view showing an example of a structure of a water-repellent film 1 produced by a method of the present invention. Reference numeral 2 represents a substrate. Furthermore, FIG. 2 is a schematic view showing a process in which a high density polymer film is formed according to one embodiment of the present invention.

In this example, $(CH_3O)_3Si(CH_2)_2(C_6H_4)(CH_2)_2Si(OCH_3)_3$ is used as the silane coupling agent (A) and $CF_3(CF_2)_7C_2H_4Si(OCH_3)_3$ is used as the silane coupling agent (B). The silane coupling agent (A) in the water-repellent film after reaction may be expressed by the following Formula 4.

(Formula 4)

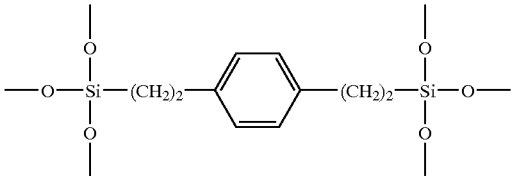

Herein, siloxane bonding (—Si—O—) is present in this film. In general, the siloxane bonding is cut by hydrolysis in an alkali solution. However, the present inventors have found that, in the structure of the water-repellent film of the present invention, in the vicinity of the siloxane bonding, a water-repellent alkyl chain, a benzene ring or a fluorocarbon chain is present and prevents an alkaline solution from entering the film. As a result, the present inventors have found that the water-repellent film is not broken in the alkali solution.

The amount of the coating solution necessary to form a water-repellent film differs depending on the application methods. However, in any application methods, the amount of the coating solution to be used is larger than the net amount necessary to form a water-repellent film on the substrate actually. For example, when the coating solution is applied by spin coating, 90% or more of the coating solution is wasted. Meanwhile, the silane coupling agent to be used for the coating solution is expensive in most cases. Therefore, in order to minimize the cost of raw materials of the water-repellent film, it is necessary to make the concentration of the silane coupling agents in the coating solution as low as possible. By the way, in general, the chemical reactions of the silane coupling agent expressed by Formulae 1 to 3 proceed faster as the concentration thereof is higher, and when the concentration is low, the reaction does not proceed. Therefore, in the case where the coating solution, which had a low concentration from the beginning, is formed, the reaction of the silane coupling agent in the coating solution proceeds insufficiently, and the polymerization between the silane coupling agents may become insufficient. Therefore, the polymerization degree of the silane coupling agents in the film formed by using the coating solution having a low concentration also becomes low, which may affect the mechanical strength of the film.

The present inventors have found that if a coating solution with high concentration is formed, the reaction of the silane coupling agents is allowed to proceed and thereafter the coating solution is diluted, even if the concentration of the silane coupling agent in the coating solution is low, it is possible to produce a coating solution in which the polymerization proceeds sufficiently Herein, the present inventors have found that if the concentration of the silane coupling agent (A) in the coating solution is 0.5 vol % or more, the reaction proceeds sufficiently. Although the water-repellent film formed by using a diluted coating solution has a film thickness that is slightly smaller than that of the water-repellent film formed by using the coating solution without being diluted, the sufficient alkali resistance can be maintained.

As mentioned above, since the water-repellent film of the present invention includes a fluoroalkyl chain and a small surface energy, it can repel various kinds of liquid such as oil, in addition to water. Furthermore, it is possible to remove solid materials attached to this film easily. Therefore, the water-repellent film of the present invention is useful as an antifouling film applicable to household equipment, for example, cooking equipment or a bedpan, to which dirt tends to attach. In particular, the water-repellent film of the present invention is useful as an antifouling film of a part exposed to a high alkaline detergent. Furthermore, the water-repellent film of the present invention is applicable to various fields, for example, application to a part that is always exposed to an alkaline solution.

EXAMPLES

Hereinafter, a specific Example of the present invention will be mentioned hereinafter. Note here that the present invention is not necessarily limited to this Example.

Stainless substrate (SUS304) having a size of 3 cm×5 cm and thickness of 100 $\mu$m was used as a substrate.

The below mentioned solutions C-1 and C-2 were prepared.

I. Solution C-1

(1) Mixed solution of ethanol and 2,2,2-trifluoroethanol (mixing at the volume ratio of 8:2): 30 ml (2) 1,4-bis(trimethoxysilylethyl)benzene ($(CH_3O)_3Si(CH_2)_2(C_6H_4)(CH_2)_2Si(OCH_3)_3$): 2 ml (3) (2-perfluorooctyl)ethyltrimethoxysilane ($CF_3(CF_2)_7C_2H_4Si(OCH_3)_3$): 0.2 ml II. Solution C-2

(1) Mixed solution of ethanol and 2,2,2-trifluoroethanol (mixing at the volume ratio of 8:2): 19.5 ml (2) Pure water: 30 ml (3) hydrochloric acid (36 vol %): 0.5 ml The solution C-2 (5 ml) was dropped into the solution C-1 while stirring the solution C-1 with a stirrer. After dropping, stirring was carried out for about one hour, and this solution was diluted 4 times with a mixed solution of ethanol and 2,2,2-trifluoroethanol (volume ratio of 8:2). This diluted solution was applied to the substrate by spin coating. The spin coating was carried out at 3000 rpm for 20 seconds. The substrate was dried at room temperature for one hour, followed by sintering thereof at 200° C. for 30 minutes.

A coating solution that had been diluted from the beginning was prepared in the following manner.

III. Solution D-1

(1) Mixed solution of ethanol and 2,2,2-trifluoroethanol (volume ratio of 8:2): 30 ml (2) 1,4-bis(trimethoxysilylethyl)benzene: 0.5 ml (3) (2-perfluorooctyl)ethyltrimethoxysilane: 0.05 ml IV. Solution D-2

(1) Mixed solution of ethanol and 2,2,2-trifluoroethanol (volume ratio of 8:2): 30 ml (2) Pure water: 30 ml (3) hydrochloric acid (36 vol %): 0.5 ml The solution D-2 (5 ml) was dropped into the solution D-1 while stirring the solution D-1 with a stirrer. After dropping, stirring was carried out for about one hour to obtain a coating solution.

For comparison, a water-repellent films were formed by using a non-diluted coating solution and a coating solution that had been diluted from the beginning, respectively.

The respective water-repellent films were evaluated in terms of the following two items.

(a) Water-repellency

A static contact angle of the water-repellent film to pure water was measured.

(b) Alkali resistance

A substrate to which a water repellent film was applied was dipped in a buffer solution of pH=9.0 and allowed to stand at 70° C. for 20 hours. Then, the substrate was taken out and a static contact angle to pure water was measured.

Note here that the buffer solution was prepared by appropriately mixing the following solutions A and B so that the mixed solution had pH=8.0.

Solution A: 0.2 M boric acid, 0.2 M sodium chloride

Solution B: 0.2 M sodium carbonate

The results of the evaluation of the water-repellent films prepared in this Example are shown in Table 1.

TABLE 1

| | Static contact angle to water (deg) | |
|---|---|---|
| Dilution ratio of coating solution | Initial value | Value after dipped in solution of pH = 9 at 70° C. for 20 hours |
| Diluted 4 times | 104 | 100 |
| Without dilution | 104 | 101 |
| Diluted 4 times from the beginning | 104 | 70 |

In this Example, the water-repellent film was formed by using three kinds of coating solutions, and regardless of the kinds of coating solutions, the amount of coating solution to be used was the same. Therefore, it was shown that if the coating solution was diluted, the amount of the silane coupling agents to be used at the time of coating was reduced.

As shown in Table 1, the water-repellent film formed by using the coating solution diluted 4 times had the same properties as those of the water-repellent film formed by using a non-diluted solution. That is, it had high initial water repellency and the water repellency was hardly lowered after being dipped in the alkali solution. This result shows that even if the amount silane coupling agent to be used is reduced, it is possible to form a water-repellent film having a high water repellency and high alkaline resistance. Therefore, by using the method of the present invention, since it is possible to reduce the amount of expensive silane coupling agent to be used, a water-repellent film can be produced at low cost.

Herein, when the coating solution that had been diluted 4 times from the beginning was used, the durability of the water-repellent film in alkali was lowered. This is because the reaction of silane coupling agents cannot proceed sufficiently in the coating solution that was diluted from the beginning, so that the polymerization degree of the obtained water-repellent film is not sufficient, which may reduce the density of the film. If the film density is low, an alkali component easily enters the film, so that the siloxane bonding (Si—O—Si) that is a component element of the film is broken easily, and consequently the alkali resistance is reduced. Therefore, as in Example of the present invention, it is possible to realize a water-repellent film having a high alkali resistance by preparing a coating solution in which a reaction of the silane coupling agents proceeds sufficiently and thereafter diluting this coating solution.

Herein, the lifetime of the non-diluted coating solution and the coating solution diluted 4 times were examined, respectively. In order to do so, after both coating solutions were prepared, they were allowed to stand for 24 hours, and applied to the substrates, respectively, to form water-repellent films. The properties of the respective water-repellent films were examined. When the non-diluted coating solution was used, it was whitened after being allowed to stand for 24 hours. The water-repellent film formed by using this whitened coating solution has a variation of the film thickness and the film surface was rougher than that of the water-repellent film prepared by using the coating solution diluted 4 times. The reason why the coating solution is whitened is thought to be because the polymerization reaction of a silane coupling agents gradually proceeds in the coating solution while it is allowed to stand for 24 hours and insoluble polymers are floating in the coating liquid. Furthermore, when the polymerization reaction of the silane coupling agents proceeds, the viscosity of the coating solution increases. Accordingly, the wettability of the coating solution with respect to the substrate is reduced, so that the coating solution cannot be applied uniformly to the surface of the substrate. As a result, the variation in the film thickness is thought to occur. The reason why the surface of the water-repellent film becomes rough is thought to be because polymers floating in the coating solution are attached to the surface of the water-repellent film. Since the water-repellent film produced by using the coating solution that was allowed to stand for 24 hours has a non-uniform film thickness and the surface thereof is rough, a uniform water-repellent film cannot be provided over the substrate. Except for limited cases, such water-repellent films are not suitable for commercial products. Therefore, the lifetime of this coating solution is 24 hours or shorter.

On the other hand, the water-repellent film prepared by using the coating solution diluted 4 times has a uniform film thickness and a smooth surface similar to the coating solution before being allowed to stand for 24 hours and has the same property as shown in Table 1. This is thought to be because the polymerization reaction between silane coupling agents does not proceed easily because the concentrations of the silane coupling agents are low in the diluted coating solution and the polymerization of the silane coupling agents after being left for 24 hours is substantially the same as that of the initial polymerization. Therefore, it was shown that the lifetime of this coating solution was 24 hours or longer.

These results show that the coating solution diluted 4 times has a longer lifetime than that of the non-diluted coating solution. If the lifetime of the coating solution is longer, since a large amount of coating solution can be stored and applied when it is needed, it becomes easy to manage the coating solution and to reduce the production cost of the water-repellent film.

As shown in the Example of the present invention, it was confirmed that the water-repellent film was able to be formed at low cost by preparing a coating solution, in which silane coupling agents had been subjected to hydrolysis and dehydration polymerization reaction, and then diluting this coating solution.

As mentioned above, it was possible to realize a highly alkali resistant water-repellent film by using the silane coupling agent according to the present invention.

Note here that in Example of the present invention, the coating solution was diluted 4 times. However, the diluting ratio is not necessarily limited to this. The concentration and the composition ratio of the silane coupling agent in the coating solution before being diluted, the concentration of water, the kinds and concentration of the catalyst, and the diluting ratio of the coating solution may be determined in accordance with the purpose. For example, in the case where the silane coupling agent is too expensive, the concentration of the coating solution before being diluted is made to be as high as possible. In doing so, the total amount of the silane coupling agent to be used at the time of formation of the coating solution can be minimized. Furthermore, if the diluting ratio is increased too much, the film thickness of the prepared water-repellent film becomes small. Consequently, the alkali resistance, the anti-abrasive property, and the like tend to be reduced. Therefore, for producing the water-repellent film that does not require so much resistance, by making the diluting ratio to be as low as possible and reducing the amount of silane coupling agent to be used, the cost can be reduced.

Furthermore, in the Example of the present invention, as the solvent, ethanol and 2,2,2-trifluoroethanol were used, the invention is not necessarily limited to this. Propanol and butanol can be used.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A method for producing a water-repellent film on a solid substrate, the method comprising;

preparing a mixed solution of a silane coupling agent (A) comprising reactive functional groups at both ends and a hydrocarbon chain and benzene ring in the middle part;

a silane coupling agent (B) comprising a fluorocarbon chain at one end and a reactive functional group at another end; and a chemical material comprising at least an organic solvent, water and acid catalyst;

allowing hydrolysis and dehydration polymerization reaction of the silane coupling agent (A) and the silane coupling agent (B) to proceed;

then diluting the mixed solution; and applying the mixed solution to the substrate and heating the substrate; thereby forming a polymer film of to silane coupling agent (A) and the silane coupling agent (B).

2. The method according to claim 1, wherein the reactive functional groups of the silane coupling agent (A) and the silane coupling agent (B) are alkoxyl groups.

3. The method according to claim 1, wherein the silane coupling agent (A) is expressed by the following general formula (a):

$$X_sQ_{3-s}Si(CH_2)_tC_6H_4(CH_2)_uSiR_{3-m}X_m \quad (a)$$

wherein Q and R represent a methyl group or an ethyl group; t and u represent a natural number between 1 and 10; s and m represent a natural number between 1 and 3, when s=1 and m=1 are satisfied, two Qs and Rs are present, respectively, but each of two Qs and Rs may have a different structure; $C_6H_4$ represents a phenylene group; and X represents an alkoxyl group, chlorine, acyloxy, or amine.

4. The method according to claim 1, wherein the silane coupling agent (B) is expressed by the following general formula (b):

$$CF_3(CF_2)_nC_2H_4SiR_{3-m}X_m \quad (b)$$

wherein R represents a methyl group or an ethyl group; n represents a natural number between 1 and 12; m represents a natural number between 1 and 3, when m=1 is satisfied, two Rs are present, but each of the two Rs may have a different structure; and X represents an alkoxyl group, chlorine, acyloxy, or amine.

5. The method according to claim 1, wherein in the mixed solution, the concentration of the silane coupling agent (A) is 0.5 vol % or more and 30 vol % or less; the concentration of the silane coupling agent (B) is 0.05 vol % or more and 3 vol % or less; the concentration of water is 0.1 vol % or more and 30 vol % or less; and the rest comprises an organic solvent and acid catalyst.

6. The method according to claim 1, wherein the organic solvent is at least one selected from the group consisting of ethanol, propanol, butanol and 2,2,2-trifluoroethanol.

7. The method according to claim 1 , wherein the acid catalyst is at least one inorganic acid selected from the group consisting of hydrochloric acid and nitric acid.

8. The method according to claim 1, wherein the acid catalyst is an organic acid represented by acetic acid.

9. The method according to claim 1, wherein the silane coupling agent (A) and the silane coupling agent (B) are subjected to hydrolysis and dehydration polymerization reaction to form an oligomer.

10. The method according to claim 1, wherein the hydrolysis and dehydration polymerization reaction of the silane coupling agent (A) and the silane coupling agent (B) are carried out at temperatures of 0° C. or more and 70° C. or less for 1 minute or longer mid 240 minutes or shorter.

11. The method according to claim 1, wherein the mixed solution is diluted with at least one diluent selected from the group consisting of ethanol propanol, butanol and 2,2,2-trifluoroethanol.

12. The method according to claim 1, wherein the mixed solution is diluted with the diluent in the range from twice to 20 times.

13. The method according to claim 1, wherein the temperature for heating the substrate is in the range from 100° C. to 400° C.

* * * * *

UNITED STATES PATENT AND TRADEMARK OFFICE

CERTIFICATE OF CORRECTION

PATENT NO. : 6,855,375 B2
DATED : February 15, 2005
INVENTOR(S) : Nakagawa et al.

It is certified that error appears in the above-identified patent and that said Letters Patent is hereby corrected as shown below:

Column 11,
Line 43, “and benzene ring” should read -- and a benzene ring --.
Line 55, “a ploymer film of to silane” should read -- a polymer film of the silane --.

Column 12,
Line 48, “longer mid 240 minutes” should read -- longer and 240 minutes --.
Line 51, “of ethanol propanol,” should read -- of ethanol, propanol, --.

Signed and Sealed this

Eleventh Day of October, 2005

JON W. DUDAS
*Director of the United States Patent and Trademark Office*